US008991224B2

(12) United States Patent
Zalavari

(10) Patent No.: US 8,991,224 B2
(45) Date of Patent: Mar. 31, 2015

(54) SECURITY APPARATUS FOR RATCHET TYPE GUNLOCKS

(71) Applicant: Santa Cruz Gunlocks, LLC., Webster, NH (US)

(72) Inventor: Tibor Kalman Zalavari, Budapest (HU)

( * ) Notice: Subject to any disclaimer, the term of this patent is extended or adjusted under 35 U.S.C. 154(b) by 0 days.

(21) Appl. No.: 14/445,206

(22) Filed: Jul. 29, 2014

(65) Prior Publication Data

US 2015/0033810 A1 Feb. 5, 2015

Related U.S. Application Data

(60) Provisional application No. 61/860,416, filed on Jul. 31, 2013.

(51) Int. Cl.
*E05B 73/00* (2006.01)

(52) U.S. Cl.
CPC ..... *E05B 73/00* (2013.01); *Y10S 70/09* (2013.01); *Y10S 224/913* (2013.01)
USPC ..... 70/18; 70/16; 70/19; 70/58; 70/279.1; 70/386; 70/DIG. 9; 206/317; 211/8; 211/64; 224/569; 224/913; 248/553

(58) Field of Classification Search
USPC ..... 70/16, 18, 19, 58–62, 279.1, 386, 70/DIG. 9; 211/4, 5, 8, 64; 42/70.11; 224/569, 912, 913; 248/551, 553; 206/317
See application file for complete search history.

(56) References Cited

U.S. PATENT DOCUMENTS

| | | | | | |
|---|---|---|---|---|---|
| 14,714 | A | * | 4/1856 | Pratt | 70/134 |
| 1,203,778 | A | * | 11/1916 | Pratt | 70/17 |
| 1,216,491 | A | * | 2/1917 | Pratt | 70/17 |
| 1,500,924 | A | * | 7/1924 | Chadwick et al. | 70/18 |
| 1,579,333 | A | * | 4/1926 | Neal | 70/16 |
| 1,856,427 | A | * | 5/1932 | Pratt | 70/17 |
| 1,890,748 | A | * | 12/1932 | Pratt | 70/17 |
| 2,516,878 | A | * | 8/1950 | Howe | 70/16 |
| 2,966,787 | A | * | 1/1961 | Tompkins | 70/16 |
| 3,326,385 | A | * | 6/1967 | Pinkerton et al. | 211/4 |
| 3,857,491 | A | * | 12/1974 | Townsend et al. | 211/8 |
| 4,138,867 | A | * | 2/1979 | Tompkins | 70/16 |
| 4,747,280 | A | * | 5/1988 | Shaw | 70/279.1 |
| 4,949,559 | A | * | 8/1990 | Glines | 70/19 |
| 5,934,112 | A | * | 8/1999 | Rice et al. | 70/18 |
| 6,044,669 | A | * | 4/2000 | Levi | 70/18 |
| 6,311,529 | B1 | * | 11/2001 | Kang | 70/16 |
| 6,568,224 | B1 | * | 5/2003 | Taper et al. | 70/16 |
| 6,684,666 | B1 | * | 2/2004 | Taper | 70/16 |
| 6,978,644 | B1 | * | 12/2005 | Taper | 70/16 |
| 7,007,518 | B1 | * | 3/2006 | Taper | 70/16 |

(Continued)

*Primary Examiner* — Lloyd Gall
(74) *Attorney, Agent, or Firm* — William B. Ritchie

(57) ABSTRACT

A security apparatus for a ratchet type gunlock that has a ratchet for locking the gunlock. The security apparatus prevents the gunlock from being shimmed using shimming techniques well known in the art. A star-shaped cogwheel having asymmetrical teeth prevents the shim from reaching the locked ratchet. The security apparatus also provides an extended ratchet latching assembly that features a pivot and a unique shoe-shaped latch that attaches to a plunger via a ball head such that the connections provided between the three elements of the latching assembly enable the latching assembly to remain locked despite severe impact, wrenching or shaking, yet can be easily opened even once the forces being applied to the gunlock ceases even when the deformation to the gunlock is irreversible.

7 Claims, 12 Drawing Sheets

(56) References Cited

U.S. PATENT DOCUMENTS

| | | | | |
|---|---|---|---|---|
| 7,047,771 | B2 * | 5/2006 | Tanos | 70/16 |
| 2006/0272366 | A1 * | 12/2006 | Kim et al. | 70/16 |
| 2012/0085135 | A1 * | 4/2012 | Louden | 70/16 |
| 2012/0118027 | A1 * | 5/2012 | Shulman | 70/16 |
| 2013/0333425 | A1 * | 12/2013 | Krelle | 70/16 |

* cited by examiner

PRIOR ART

PRIOR ART

SECURITY APPARATUS FOR RATCHET TYPE GUNLOCKS

This application claims benefit of U.S. Provisional Application Ser. No. 61/860,416, filed Jul. 31, 2013, pursuant to 35 USC §119(e).

FIELD OF THE INVENTION

This invention relates to gun racks and locks, and, more particularly, to gun racks and locks adapted to mount rifles and shotguns using an improved ratchet locking mechanism.

BACKGROUND OF THE INVENTION

Law enforcement personnel often carry firearms in their vehicles. These weapons, which include shot guns, rifles, assault rifles and other types of long guns, are often stored in a gunlock fastened securely to a gun rack attached to the vehicle. The gun rack is most commonly mounted either horizontally or vertically at an interior location in the vehicle, and, generally, is mounted in substantially parallel to a planar region serving as the mounting base in the vehicle, such as a floor, a sidewall or the ceiling.

The design of the storing assembly must provide for immediate release of the weapon when needed by the law enforcement officer. Yet, easy access to the weapon can present a problem; for example, if an intruder or other unauthorized person attempted to misappropriate the weapon.

Further complicating the problem is the fact that whereas in the past, law enforcement personnel generally carried only one type of weapon, typically a service revolver, today, they must have a variety of weapons having considerably differing sizes and configurations. The choice of location at which the weapon is stored in the vehicle varies considerably depending on individual preference, the weapon selected and the geometry of the vehicle.

One particular gunlock that is well suited to meet these requirements is made by Santa Cruz Gunlocks, LLC of Webster, N.H. This is their Model SC-5. This gunlock is disclosed in U.S. Pat. No. 7,047,771 B2, issued to Tanos on May 23, 2006. The '771 patent is hereby incorporated into this application in its entirety. In summary, the SC-5 gunlock has a pivotably attachable ratchet arm, which resembles typical handcuffs. A plurality of ratchet teeth enables the gunlock to clamp a wide variety of cross-sectional portions of different weapons sizes and shapes.

A solenoid has a plunger adapted to engage one of the ratchet teeth of the ratchet arm to lock the rotatable ratchet arm in position around the cross-sectional portion of the weapon to be locked. The solenoid locking assembly is releasable via a switch and can be overridden with a key.

A slide bar is moveably attached to the gunlock. The slide bar is provided for mounting the assembly to a suitable surface in a storage location. The gunlock is held in place on the slide bar with a setscrew assembly that can only be reached when the gunlock is open.

Although the SC-5 gunlock fully meets the safety requirements of its intended use and typical environment (supervised location such as a police car, police station gun room, etc.), changing demands have created the need for a higher level of security than present with the SC-5. Despite the overall high degree of acceptance the SC-5 gunlock has received in the industry, the Applicant realized that several improvements could be made that would render the lock more impervious against unwanted opening by the use of an extending ratchet latch in combination with an anti-shimming apparatus.

There is not found in the prior art a ratchet type of gunlock as described above that features an apparatus that prevents an unwanted opening by shimming, prevents unwanted opening by forceful opening even under extreme conditions that result in structural distortion of the gunlock.

SUMMARY OF THE INVENTION

It is an aspect of the invention to provide an improved ratchet type gunlock apparatus that has a ratchet that can be activated by a solenoid.

Another aspect of the invention is to provide an improved ratchet type gunlock apparatus that cannot be shimmed using techniques well known in the art.

Still another aspect of the invention is to provide an improved ratchet type gunlock apparatus that cannot be opened by impact, wrenching or shaking.

Finally, it is an aspect of the invention to provide an improved ratchet type gunlock that can achieve a much higher level of security against unwanted opening by making simple modifications to the basic structure of the prior art gunlock, the SC-5.

DETAILED DESCRIPTION OF THE INVENTION

Figure 1:
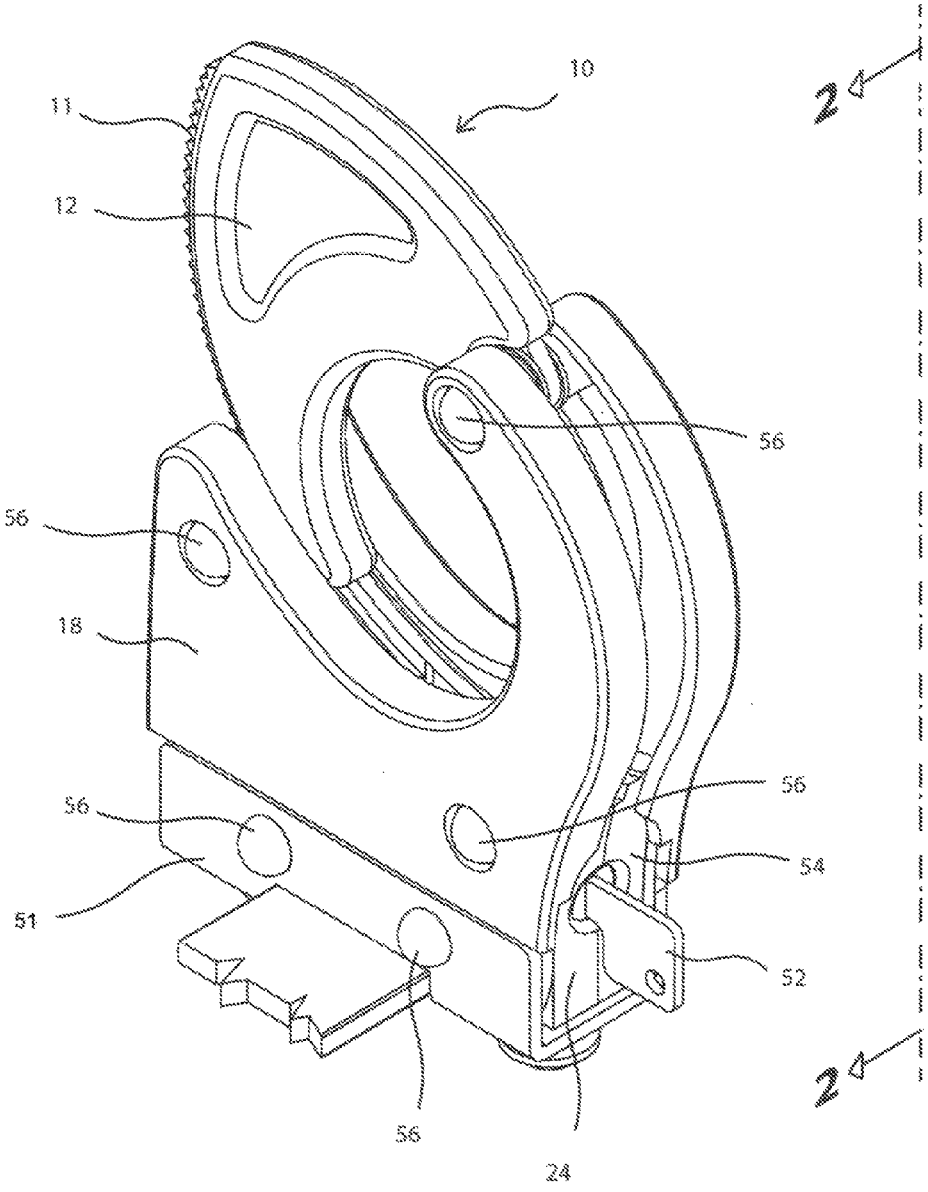
FIG. 1 is an isometric view of the prior art ratchet gunlock.
Figure 2:
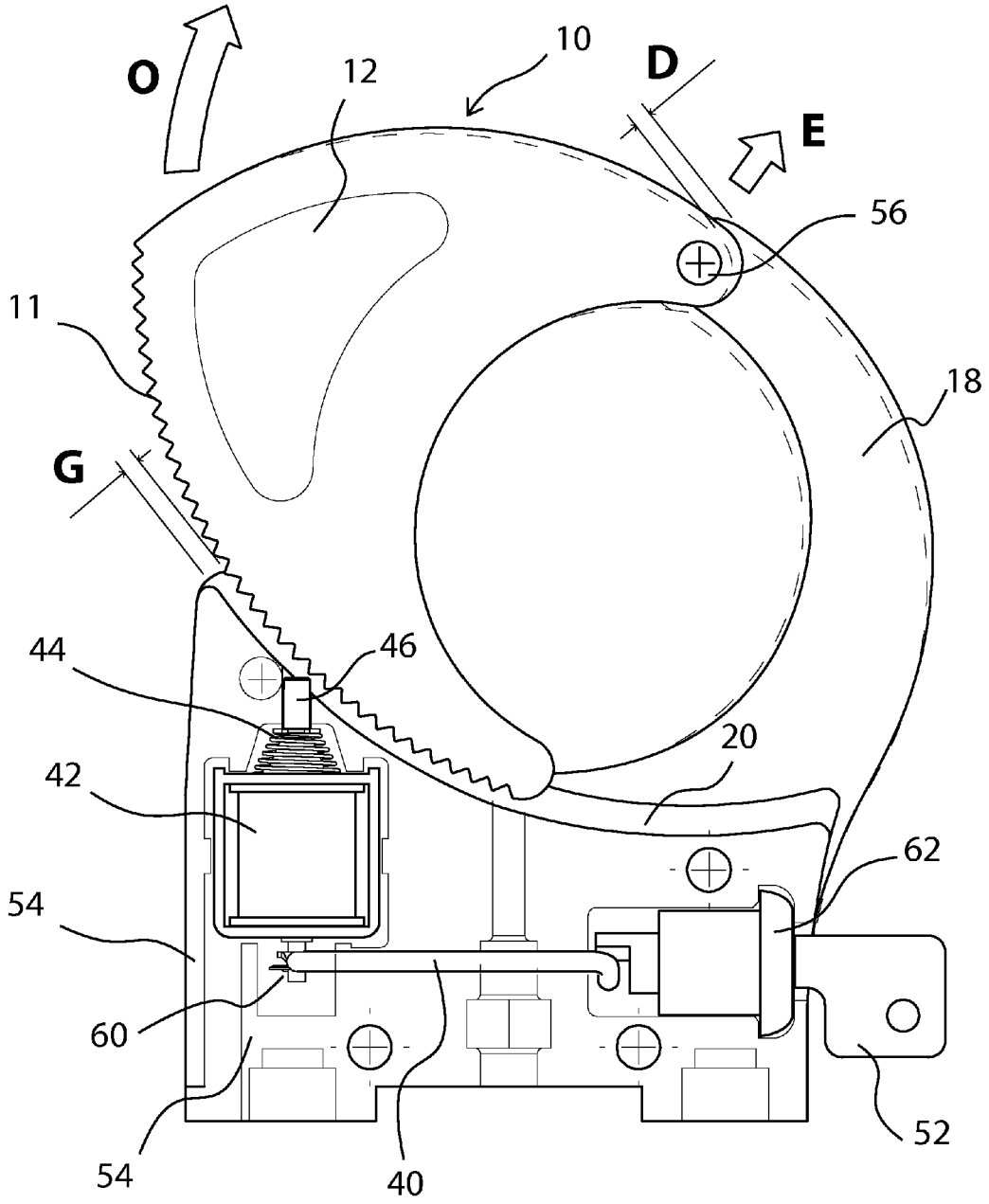
FIG. 2 is a side cross-sectional view of the prior art ratchet gunlock shown in FIG. 1 depicting how a gap can be obtained in the locking mechanism when a ratchet gunlock is subjected to severe impact, wrenching or shaking.

As shown in FIGS. 1 and 2, the prior gunlock, Model SC-5, manufactured by Santa Cruz Gunlocks of Webster, N.H. is a handcuff ratchet device that was designed primarily for a supervised environment. The universal adjustable gunlock apparatus 10 is shown. Typically, gunlock 10 is mounted to a storage surface.

U-shaped base plate 51 has a left casting 54 fastened to an identical right casting via rivets 56 as shown. Gunlock 10 is assembled with a pivotal ratchet arm 12, which is rotatably attached between opposing side plates 18 using rivets 56. Ratchet arm 12 has a plurality of ratchet teeth 11. Opposing side plates 18 are attached interposed between opposing legs of base plate 51 using rivets 56. Once assembled, gunlock 10 has the appearance of a ratchet-type of handcuff that can be easily adjusted to varying diameters in order to accommodate different parts of various weapons. Covering ratchet arm 12 is a cushion (not shown) that is preferably a rubberized material that prevents the weapon from scratched from the metal of arm 12. Similarly, cushions cover the metal side plates 18.

To lock gunlock 10, plunger 46 engages one of ratchet teeth 11, thusly releasably holding arm 12 in that position. Locking assembly 24 may be unlocked electrically using solenoid 42 or mechanically by key 52 in lock 62 as shown. Activating solenoid arm 40, which is attached to solenoid 42 via retainer clip 60 causes plunger 46 to disengage from ratchet teeth 11, thus freeing the lock to open. Spring 44 keeps plunger 46 urged against one of ratchet teeth 11. This causes locking assembly 24 to again become locked. Consequently, an electrical failure causes the device to fail safely by keeping the gun in a locked position.

Despite the relative few number of parts comprising the apparatus, invention 10 is able to lock a large variety of weapons having different cross-sectional configurations and in both vertical and horizontal orientations.

As shown in FIG. 2, severe shaking or mechanical distortion E, the structural elements of gunlock 10 deform D and ratchet arm 12 separates from plunger 46 providing gap G and the gunlock is free to open O since plunger 46 no longer engages teeth 11.

Figure 3:
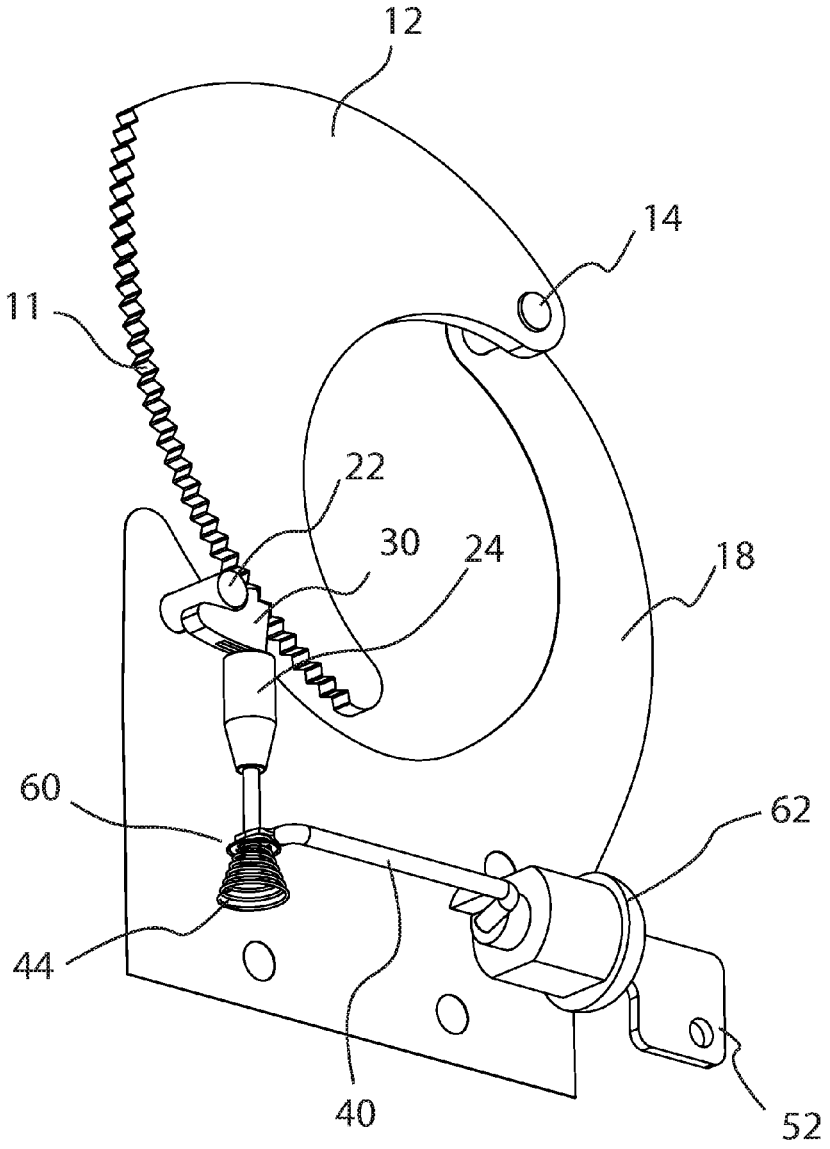
FIG. 3 is a partial cross-sectional isometric view of the extending ratchet latch in place on the gunlock shown in FIG. 1.
Figure 4:
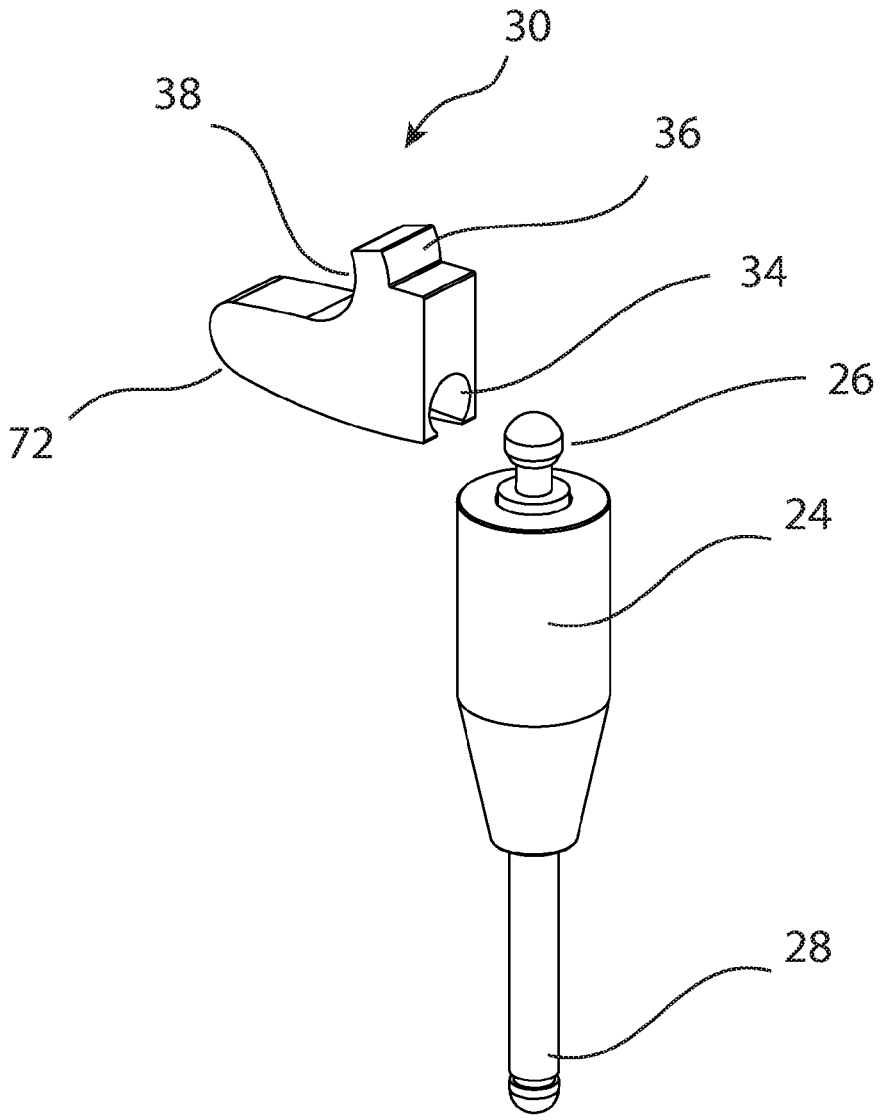
FIG. 4 is a detailed isometric view of the extending ratchet latch showing how the extending ratchet latch interacts with the ball-headed plunger.

Referring now to FIGS. 3 and 4, a partial cross-sectional isometric view and a detailed isometric view of the extending ratchet latch 30 in place on the gunlock 10. In this modification of the original SC-5, enclosed in plate 54, plunger 46 is replaced by plunger 24, stainless steel pivot 22 and extending ratchet latch 30, all of which are used to fasten gunlock 10. The opening mechanism interlocks with extending ratchet latch 30 via ball joint connection with ball head 26 of plunger 24 fitted into a rounded slot 34 of extending ratchet latch 30. Head 72 of latch 30 features sliding surface 38, which engages stainless steel pivot 22.

For normal operation, the force of plunger 24 is transmitted to latch 30 by ball head 26 and slot 34. This connection permits extending ratchet latch 30 to move relative to the axis of plunger 24 in a curve defined by stainless steel pivot 22 as ball head 26 slides in slot 34. This special mechanical connection between the parts of the ball head 26 and slot 34 provides a rotational displacement connection. If there is no force tending to distort gunlock 10, this mechanism permits an interlock with ratchet teeth 11 and the free connection with plunger 24 and extending ratchet latch 30.

Figure 5:
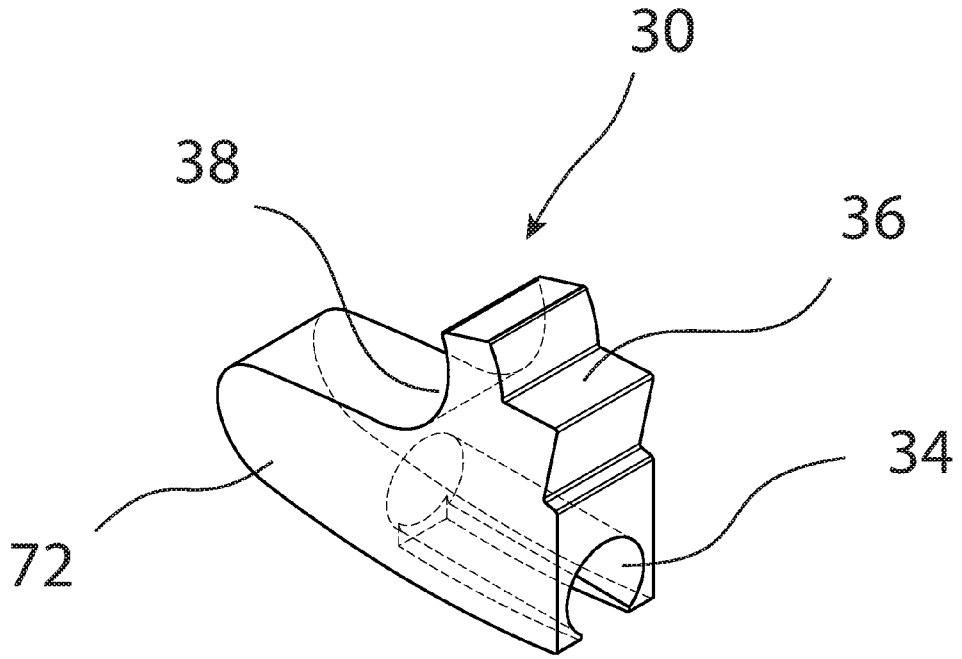
FIG. 5 is a detailed cross-sectional isometric view of the extending ratchet latch.
Figure 5:
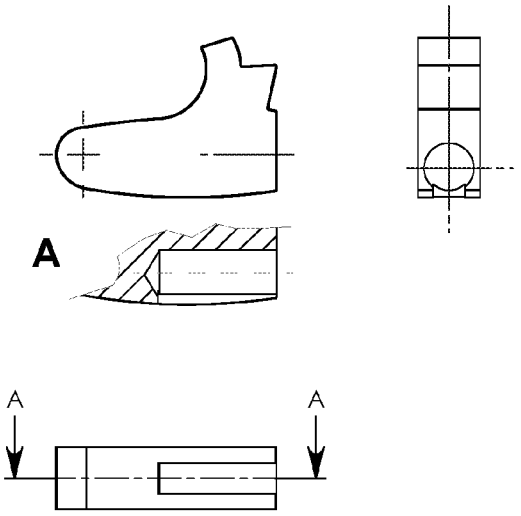

As shown in FIG. 5, a detailed view of extending ratchet latch 30 is provided. Head 72 has a shoe-shaped appearance. The opening mechanism (solenoid plunger assembly shown in FIG. 3) has sliding surface 38 that engages pivot 22. Teeth 36 are dimensioned to engage teeth 11 of ratchet arm 12. In operation, extending ratchet latch 30 operates by using the concave groove that is sliding surface 38 and a convex pin, pivot 22. Teeth 36 of latch 30 perform the pawl function, which was performed by plunger 24 in the original design.

Figure 6:
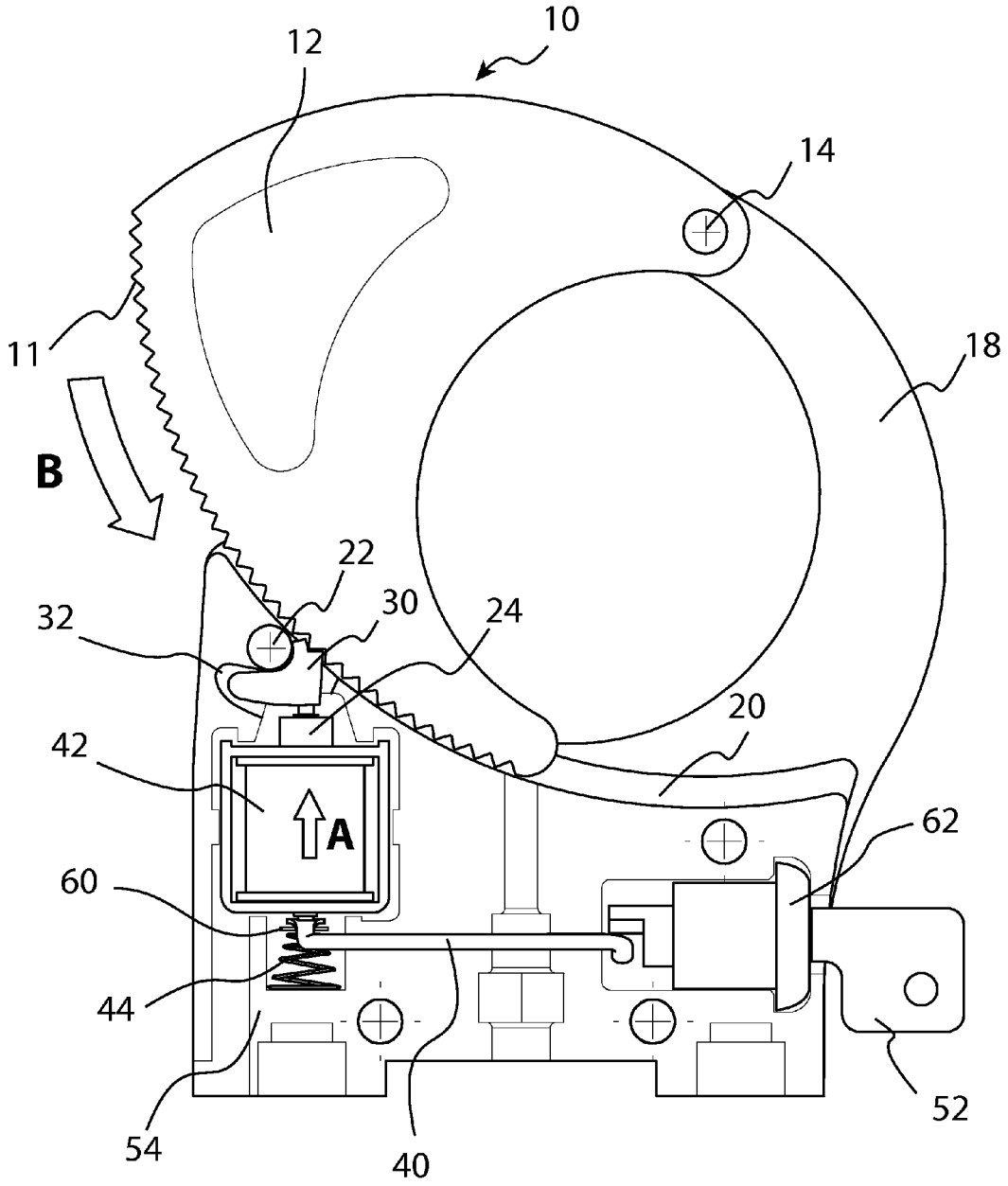
FIG. 6 is a side view of the extending ratchet latch holding the gunlock in a locked state.
Figure 7:
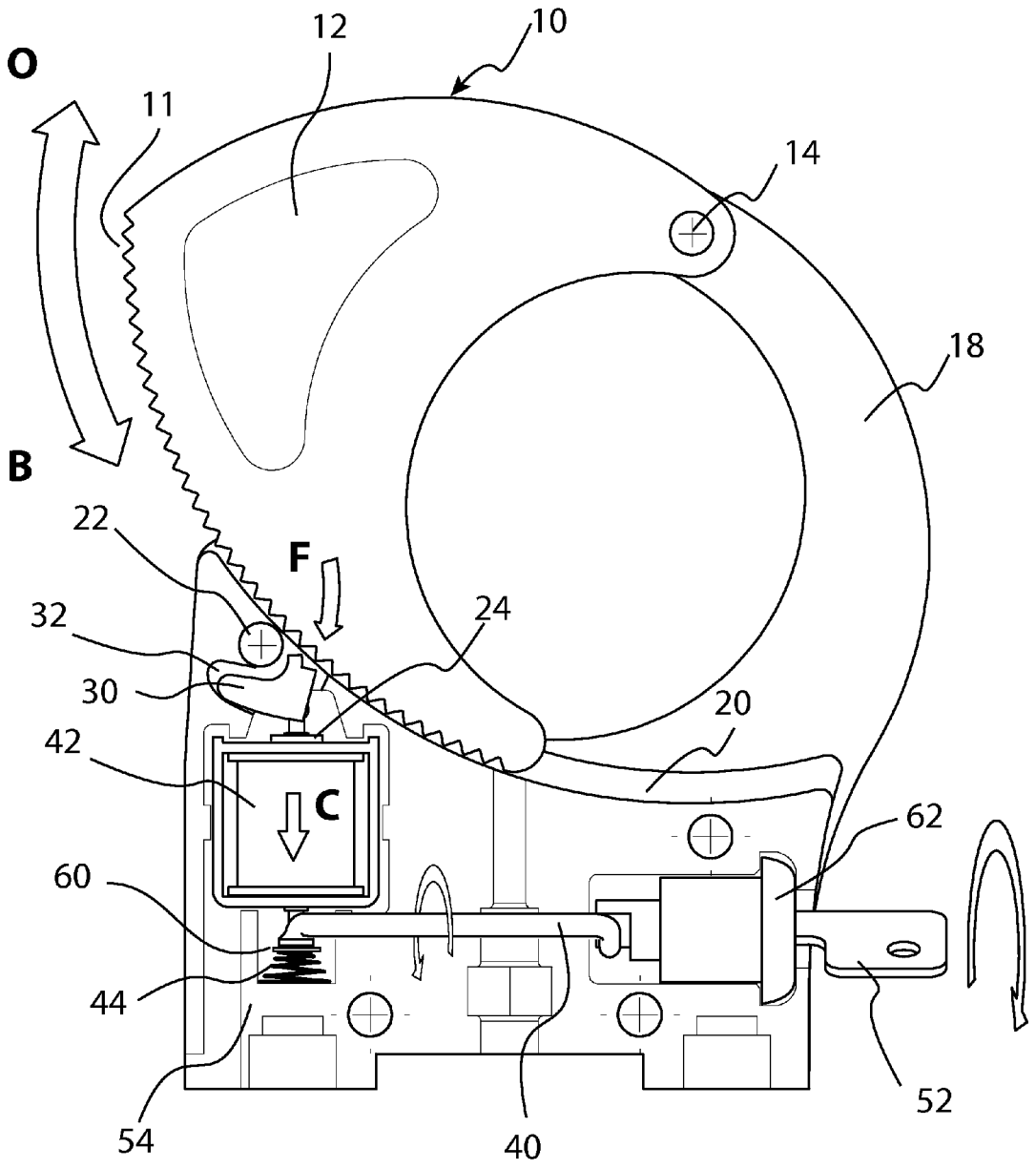
FIG. 7 is a side view of the extending ratchet latch allowing the gunlock to be in an openable state.
Figure 8:
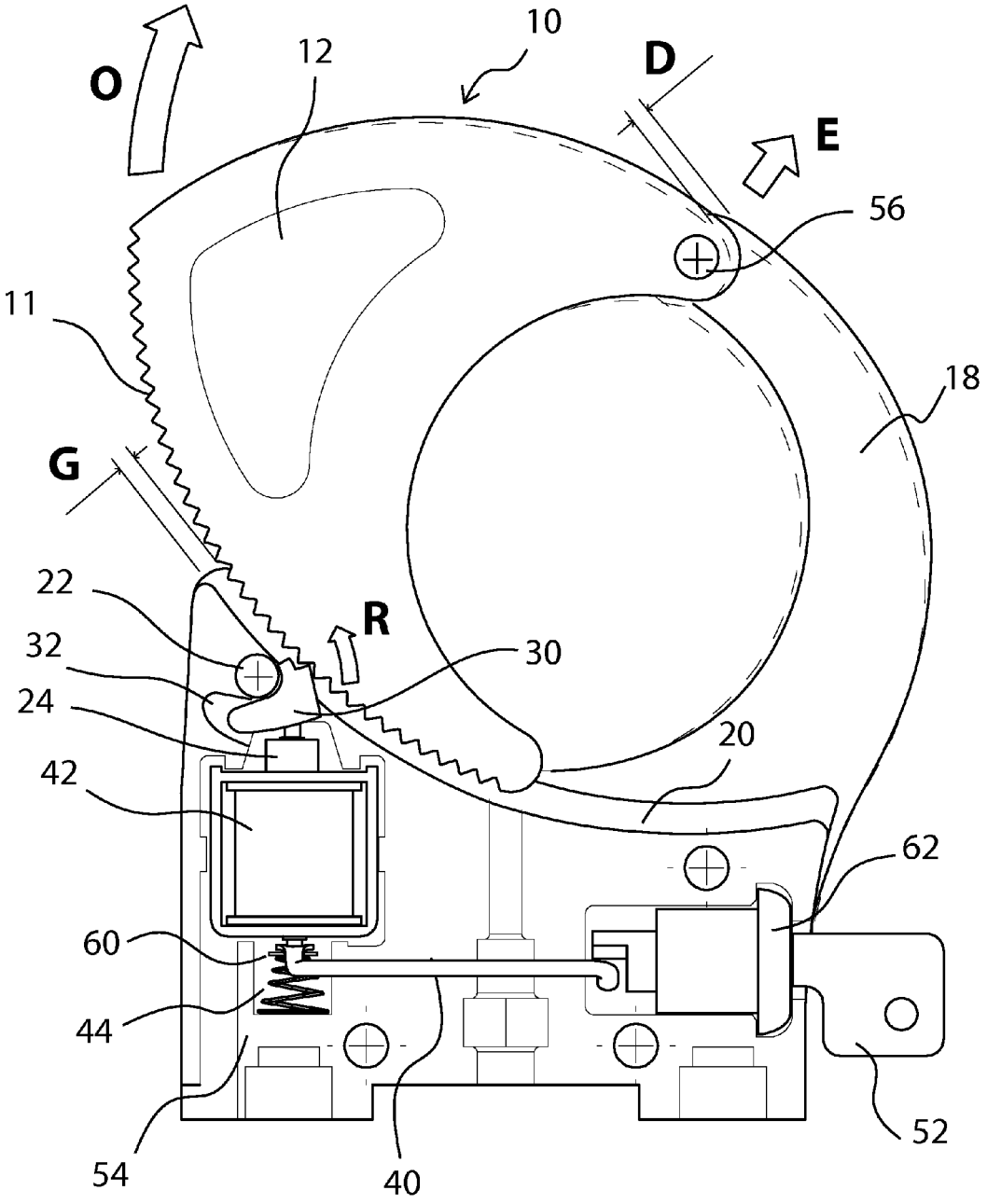
FIG. 8 is a side view of the extending ratchet latch in a forced condition such that the extending ratchet latch is wedged but still provides a locked state.

Referring now to FIGS. 6, 7, and 8, the function of extending ratchet latch 30 with gunlock 10 is depicted. FIG. 6 shows the normal locked condition. FIG. 7 shows the unlocked condition and FIG. 8 shows the forced state of operation.

The two directions of motion allow latch 30 to be released by the action of plunger 24 upon normal opening but also to follow the changing position of ratchet arm 12 to hold gunlock 10 closed during an unauthorized attempt when force E (FIG. 8) is applied to deform structure D. In the latter case, latch 30 pivots around pivot 22 and ratchet arm 12 pulls it in the direction of opening by means of latch 30's tooth-like surface 36. When forcibly turned, latch 30 engages in teeth 11 of ratchet arm 12 via the other tooth of latch 30 which is at a greater radius from pivot 22 than the first tooth of latch 30, thus causing latch 30 to wedge between pivot 22 and teeth 11 of ratchet arm 12, causing arm 12 to remain locked despite gap G. Thus, latch 30 continuously extends between pivot 22 and ratchet arm teeth 11. Upon application of still more force, the constrained interlocking of teeth 36 of latch 30 causes latch 30 to turn further on pivot 22 with ball head 26 free to slide in slot 34 and present a still larger cross-section by virtue of latch 30's wedge-like geometry, thus still remaining locked.

As noted above, the rotational displacement ability of latch 30 is obtained from the special mechanical connection between the longitudinal round-section slot 34 in latch 30 and the ball plunger head 26, which fits into slot 34. After the force E tending to pull gunlock 10 apart ceases, the flexible mechanism of ratchet arm 12 and latch 30 returns from the deformed state; the interlock with ratchet arm teeth 11 and the free connection with plunger head 26 allows latch 30 to return to its normal position. Operation of plunger 24 provides the normal mode of disengaging latch 30 from ratchet arm teeth 11 wherein gunlock 10 can be opened. This normal opening capability is retained even after irreversible deformation of gunlock 10 has occurred.

Figure 9:
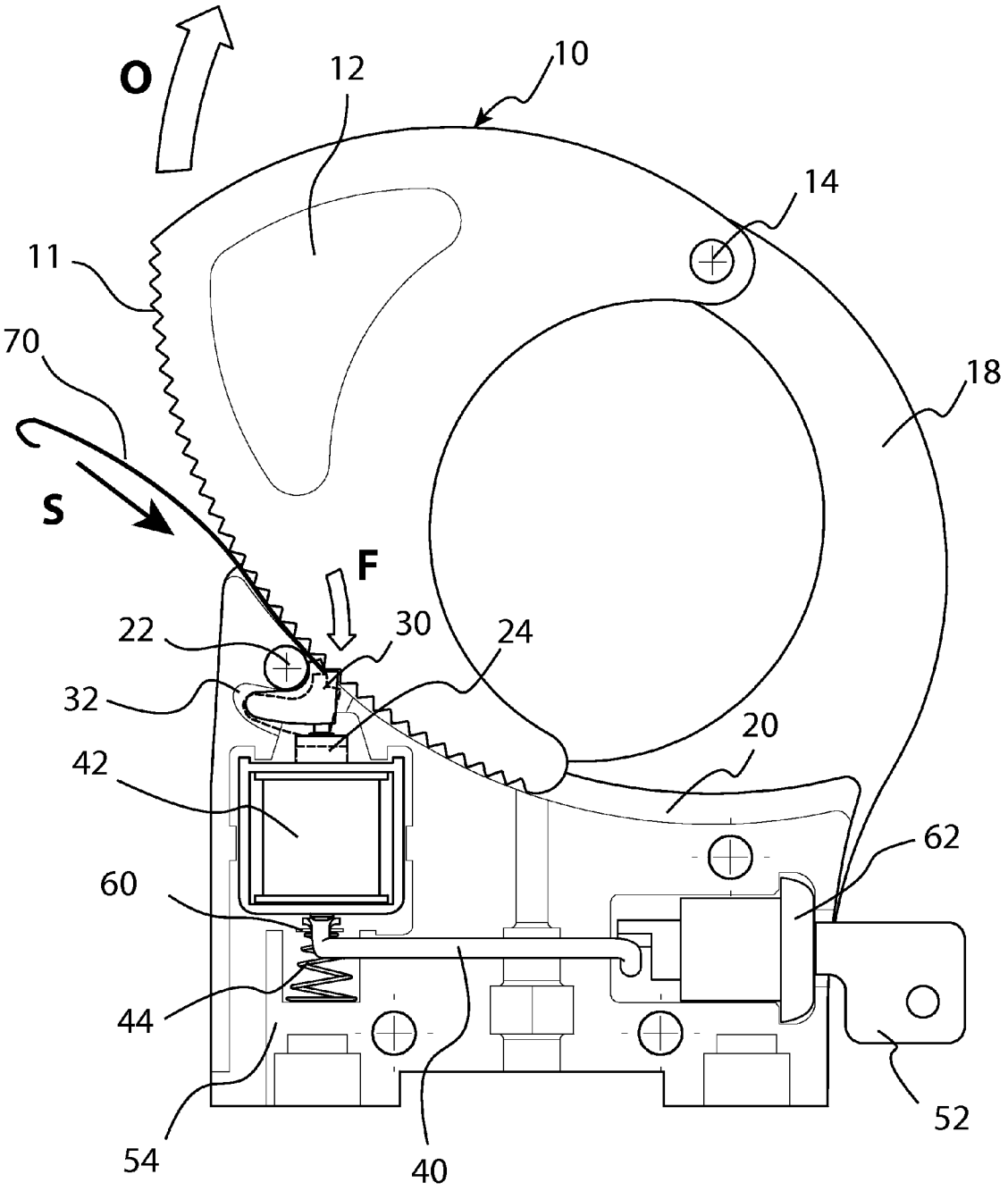
FIG. 9 is a side cross-sectional view of the ratchet gunlock with the extending ratchet latch in place showing how the gunlock can still be "shimmed".

Referring now to FIG. 9, gunlock 10 is shown to be able to be shimmed open despite the addition of latch 30. Shimming involves the use of sliding a thin strip 70 between teeth 11 and lock casing 54. Pushed in direction S, shim 70 reaches latch 30 and moves latch 30 in direction F and frees ratchet arm 12, allowing gunlock 10 to open.

Figure 10:
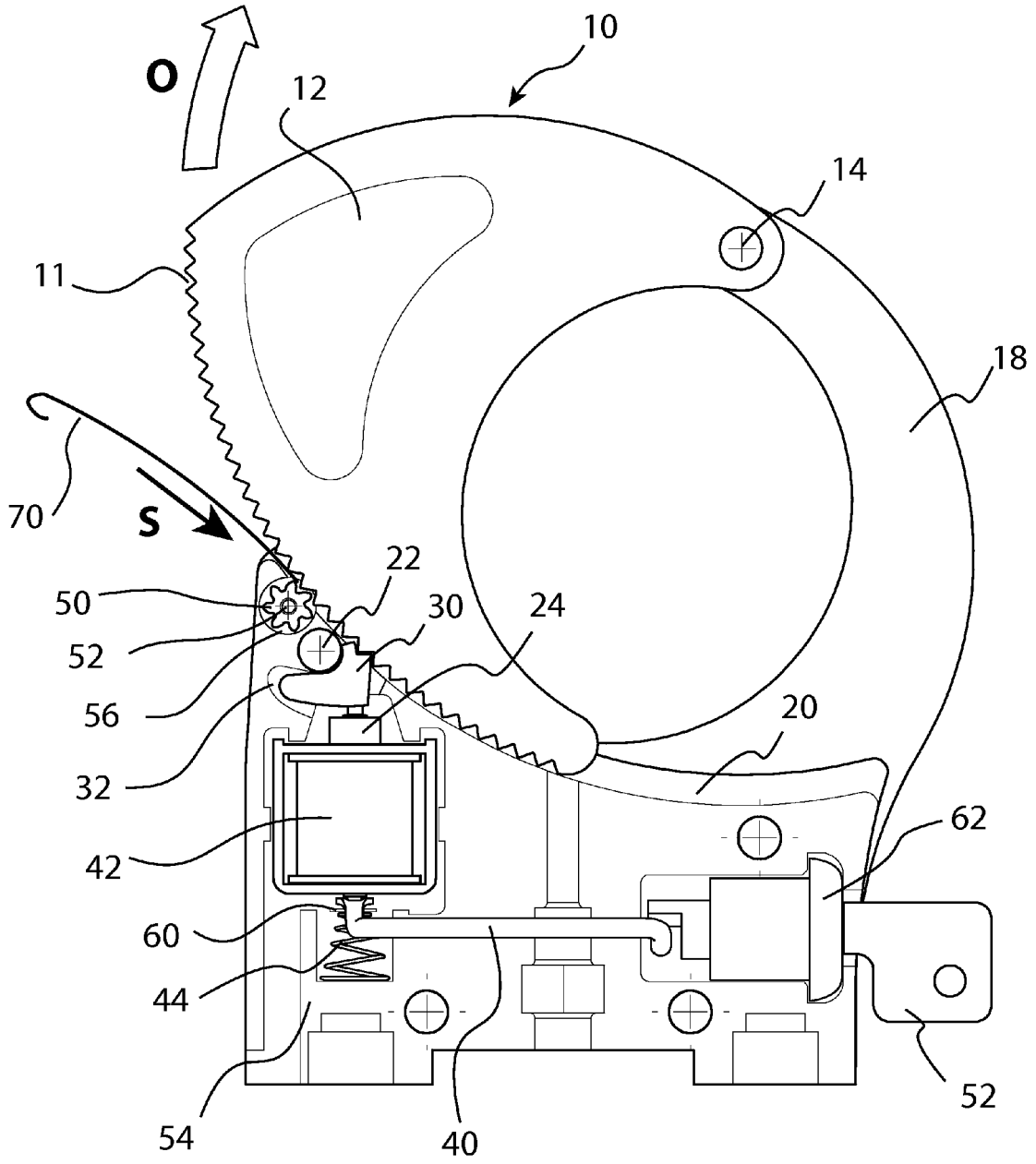
FIG. 10 is a side cross-sectional view of the ratchet gunlock with the extending ratchet latch and the anti-shimming wheel in place showing how the gunlock can no longer be shimmed.
Figure 11:
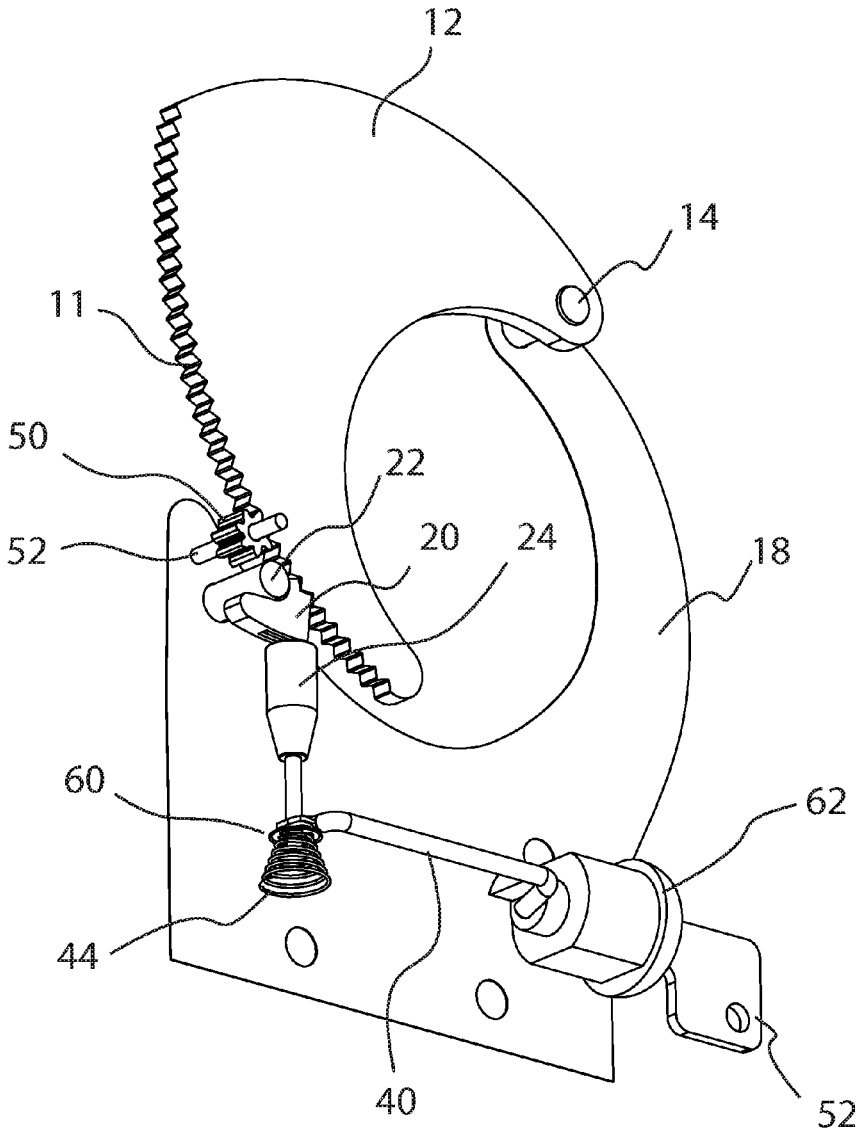
FIG. 11 is a partial cross-sectional isometric view of the extending ratchet latch and the anti-shimming wheel in place on the gunlock shown in FIG. 1.
Figure 12:
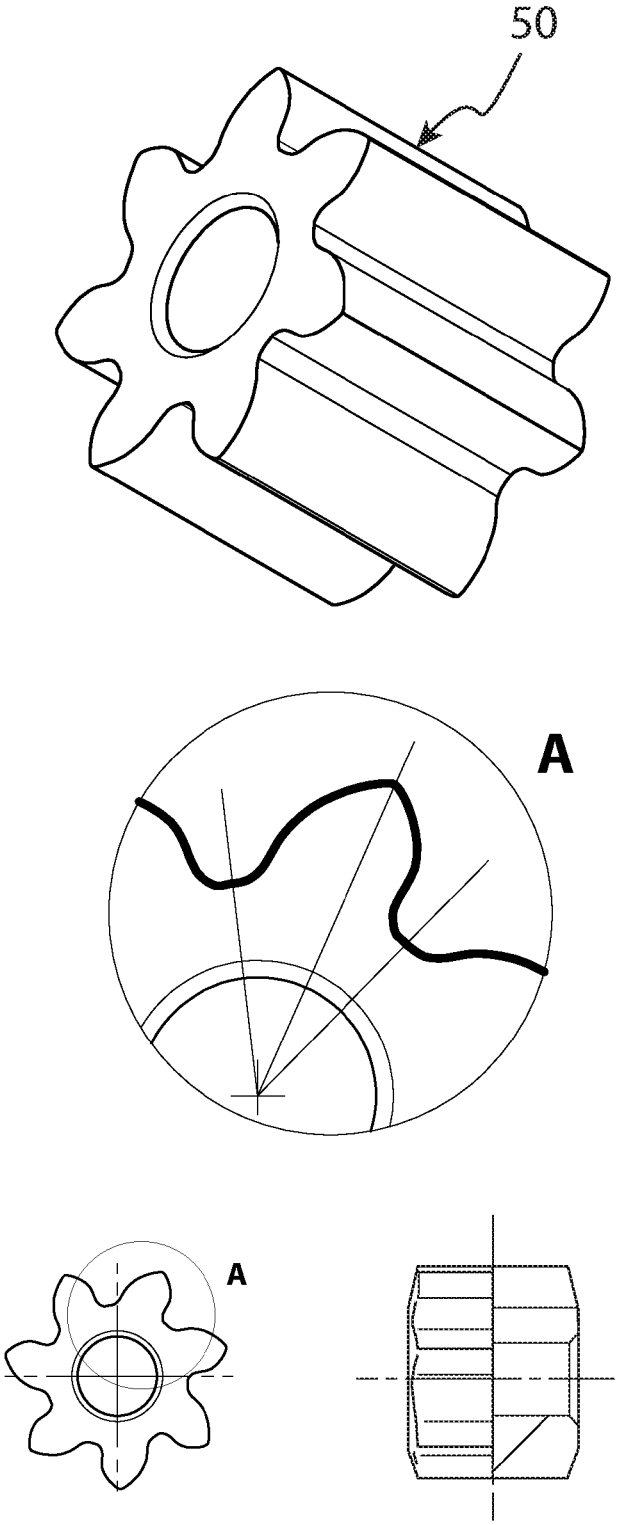
FIG. 12 is a detailed isometric view of the anti-shimming wheel.

A solution to this problem was found by the introduction of an anti-shimming apparatus, which is starwheel 50 as shown in FIGS. 10, 11 and 12. Starwheel 50 presents an obstacle to shim 70 to prevent shim 70 from pushing down against latch 30 to disengage it from teeth 11. Starwheel 50 is a freely-rotating cogwheel whose profile is dimensioned to fit teeth 11 of arm 12. Starwheel 50 is placed in front of latch 30 so that the pawl action of latch 30 cannot be prevented. As shown, starwheel 50 is specially designed to smoothly engage with teeth 11 of ratchet arm 12. Starwheel 50's teeth have a shark-tooth-like, asymmetric profile, thus allowing ratchet arm 12 to move freely. Since the teeth of starwheel 50 and teeth 11 of arm 12 are constantly engaged with one another, the motion of shim 70 is always prevented from reaching latch 30. Even if shim 70 were sufficiently flexible so that it could worm its way between the teeth of starwheel 50 and teeth 11, shim 70 would be in such a deformed state that it lacks the ability to release latch 30. Normally unlocking plunger 24 causes latch 30 to disengage from teeth 11 of ratchet arm 12, permitting free movement of arm 12 and since starwheel 50 is freely rotatable, starwheel 50 does not impede arm 12 from being released.

Although the present invention has been described with reference to certain preferred embodiments thereof, other versions are readily apparent to those of ordinary skill in the preferred embodiments contained herein.

What is claimed is:

1. A security apparatus to prevent unauthorized opening of a ratchet type gunlock having a pivotal ratchet arm with a plurality of ratchet teeth and having two opposing side plates wherein said ratchet arm is rotatably and releasably attached between said two opposing side plates such that a firearm can be secured to said ratchet type of gunlock, said apparatus comprising:

a stationary cylindrical pivot pin affixed between said two opposing side plates;

a plunger having a ball head affixed to said plunger wherein activating said plunger causes at least one of said plurality of ratchet teeth of said ratchet arm to be engaged thus locking the weapon in the gunlock;

an extended ratchet latch having a rounded slot adapted to moveably engage with said ball head of said plunger to provide a ball joint connection; and wherein said extended ratchet latch further comprising a head with a concave sliding surface to provide a rotational connection to said cylindrical pivot pin via said concave sliding surface of said extended ratchet latch; and wherein said ball joint connection and said rotational connection together provides a rotational displacement connection for said extended ratchet latch; and wherein said extended ratchet latch further comprises:

a first tooth and a second tooth, said teeth adjacent to one another and each of said teeth dimensionally adapted to engage said at least one tooth of said ratchet teeth of said ratchet arm of said gunlock; and wherein the first tooth of said extended ratchet latch locks said gunlock during non-stressed use of said gunlock and the second tooth of extended ratchet latch locks said gunlock when said gunlock is subjected to severe shaking or mechanical distortion forces being applied to said ratchet arm of said gunlock;

such that said second tooth due to the rotational displacement connection provided by said extended ratchet latch is at a greater radius from said cylindrical pivot pin than the radius provided by said first tooth, thus causing said second tooth of said extended ratchet latch to wedge between said cylindrical pivot pin and said ratchet arm of said gunlock, thus keeping said gunlock locked despite a gap that occurs between said ratchet arm and said cylindrical pivot pin.

2. The apparatus of claim 1 wherein said plunger is activated by a solenoid.

3. The apparatus of claim 1 wherein said plunger is activated by a key.

4. The apparatus of claim 1 further comprising a cogwheel placed in front of said extended ratchet latch and attached between said side plates of said gunlock; and wherein said cogwheel having a plurality of teeth to prevent a shim from reaching said extended ratchet latch and said shim from pushing down said extended ratchet latch to improperly open said gunlock.

5. The apparatus of claim 4 wherein said cogwheel is freely rotating.

6. The apparatus of claim 4 wherein said teeth of said cogwheel have an asymmetric profile to allow said ratchet arm of said gunlock to move freely.

7. The apparatus of claim 4 wherein said teeth of said cogwheel are constantly engaged with said ratchet teeth of said pivotal ratchet arm.

* * * * *